US005105745A

United States Patent [19]

Tarassoff

[11] Patent Number: 5,105,745

[45] Date of Patent: Apr. 21, 1992

[54] RHYTHM DEVICE OF A DETACHABLE TRANSPORT APPARATUS

[75] Inventor: Serge Tarassoff, Seyssinet-Pariset, France

[73] Assignee: Pomagalski S.A., Fontaine, France

[21] Appl. No.: 631,466

[22] Filed: Dec. 21, 1990

[30] Foreign Application Priority Data

Jun. 13, 1990 [FR] France ..... 90 07598

[51] Int. Cl.[5] ..... B61B 7/00

[52] U.S. Cl. ..... 104/179; 104/178; 104/184

[58] Field of Search ..... 104/173.1, 173.2, 178, 104/179, 184

[56] References Cited

U.S. PATENT DOCUMENTS

| | | | |
|---|---|---|---|
| 4,627,361 | 12/1986 | Tarassoff | 104/178 |
| 4,669,389 | 6/1987 | Tarassoff | 104/178 |
| 4,744,306 | 5/1988 | Kunczynski | 104/173.1 |
| 4,843,968 | 7/1989 | Rikli | 104/173.1 |
| 4,942,823 | 7/1990 | Meindl | 104/178 |

*Primary Examiner*—Robert J. Oberleitner
*Assistant Examiner*—Mark T. Le
*Attorney, Agent, or Firm*—Parkhurst, Wendel & Rossi

[57] ABSTRACT

A rhythm device section is controlled by a controller, which controls the travelling time of the carriage in terms of the delay or advance and repositions the carriage correctly with respect to a periodic signal synchronized with the cable. The controller in addition detects successive identical deviations and in this case triggers dephasing of the periodic signal so as to rephase it with the passing of the carriages.

7 Claims, 2 Drawing Sheets

RHYTHM DEVICE OF A DETACHABLE TRANSPORT APPARATUS

BACKGROUND OF THE INVENTION

The invention relates to a continuously moving overhead cable transport installation, to which loads, notably gondolas or chairs, spaced along the line are coupled by detachable grips, the carriages being uncoupled from the cable at the entrance to station to run on a transfer rail before being recoupled to the cable at the exit from the station, the spacing of the carriages along the line being determined by the frequency of the departures, in which installation the running circuit of the carriages in the station between the uncoupling zone and the coupling zone to the cable comprises a continuously moving rhythm device section equipped with a rhythm device capable of varying the travelling time of the carriages on said rhythm device section, to correctly reposition a carriage staggered with respect to a periodic signal synchronized with the running of the cable.

The U.S. Pat. No. 4,627,361 describes a rhythm device of the kind mentioned which maintains regular spacing of the gondolas or chairs, hereafter called carriages, throughout the day. This device operates perfectly to compensate an accidental staggering of a carriage, due among other things to a driving incident or to local braking, but it gives rise to certain problems when variations occur affecting the whole installation, for example when the jacks or tension counterweights of these installations lengthen or shorten the useful length of the cable and thereby the travelling time of the carriages, which must all be repositioned correctly. The adjustment margin is set in terms of these general variations and naturally of the risks of individual staggering, and it quickly becomes great and incompatible with high capacities implying minimum spacings of the carriages.

The object of the present invention is to improve the abovementioned rhythm device with a view to reducing its operations and to achieve an installation with a high capacity without the risk of collision between the cars and without the latter stopping.

SUMMARY OF THE INVENTION

The installation according to the invention is characterized in that it comprises a detection device detecting an identical stagger of several successive carriages and that said detection device, when several successive identical staggers occur, triggers a corresponding respacing and a rephasing of said signal with the running of the carriages.

The rhythm device checks whether the arrival of a carriage, for example at the entrance to the rhythm device section, coincides with the periodic signal and in the case of a deviation determines whether this deviation is general or individual, by comparing it to the deviations of the previous carriages, notably of the previous three or four carriages. If the deviations are all the same, they are attributed to a dephasing between the periodic signal and the running of the carriages, and the rhythm device repositions the periodic signal by a corresponding value to make the signal and the arrival of the carriages correspond again. Systematic operation of the rhythm device is thus avoided for all the following carriages, the operations being limited to an individual deviation. The adjustment range of the rhythm device is thus quickly reconstituted and becomes independent of the general fluctuations. It is clear that the spacing of the carriages remains correct, only the two carriages which had entered the rhythm device section, respectively before and after the rephasing of the periodic signal, being closer or farther apart depending on whether the dephasing was in advance or behind. This difference is corrected automatically at the next passage. If the spacing is too small and is liable to cause an accident, this incident is indicated or preferably results in shutdown of the installation.

The invention can be applied to different types of rhythm devices, its implementation having to be adapted to the type of rhythm device used. In the case of a rhythm device according to the above-mentioned U.S. Patent, having a rhythm device section equipped with two drive means, one with a chain with push fingers synchronized with the cable and the other with tired wheels, the periodic signal is given by the passing of the fingers and a difference with the passing of the carriages results in a more or less fast catch-up depending on whether the carriages are in advance or behind. By detecting the catch-up point by any operating means, it is easy to detect a dephasing, when two or more successive carriages are all caught up at the same staggered point. Rephasing is then achieved by slightly staggering the chain with push fingers with respect to the cable.

In the preferred embodiment according to the invention, the rhythm device section is equipped with a train of tired wheels to drive the carriages by friction, and this wheel train can be driven at two different speeds. In normal operation, it operates at a first speed, for example slow, during the first half of the travel of a carriage over the section and thereafter at the fast speed. When a carriage is behind, switching to fast speed takes place before the halfway point on the section so as to catch up the delay and vice-versa. The rhythm device, in this case the speed changer, is advantageously controlled by a controller, which may be that of the installation, or by any other electronic processor. The controller receives on the one hand a periodic signal synchronized with the cable, for example sent by one or more marks carried by the cable return wheel, and on the other hand a signal of the carriages passing, for example a signal that a carriage is entering the rhythm device section. When the carriages are positioned correctly the two signals coincide and the controller does not trigger a repositioning. The change of driving speed takes place halfway along the rhythm device section. Any difference between the two signals is detected by the controller comparator, which makes the speed change take place earlier or later, to catch up the delay or compensate for an advance, respectively and reposition the carriage correctly. The difference between the two signals is stored in memory and the number of successive identical differences is counted by the controller. If this number exceeds a preset value, for example 3 or 4, the controller sends a dephasing order of the periodic signal, notably a time delay or advance, to compensate for the deviation noted. The frequency of the periodic signal determines the running rate of the carriages and this signal can be supplied by the controller clock if the speed of the cable is well established. The signals of the carriages passing translate the spacing between the carriages and the controller measures the difference between two successive signals and generates an alarm or installation shutdown signal when this difference is lower than a displayed threshold, which corresponds to a risk of collision between the carriages, possibly after the correction which may have been made by the rhythm device. Any dangerous situations are thus avoided while maintaining a minimum spacing between the carriages and thereby a maximum running capacity of the installation.

The rhythm device section can comprise a drive means derived from the cable or an individual motor and gear-box, with two or more speeds, controlled by the controller to reposition the carriages. The drive can also be at constant speed, but adjustable by the controller to vary the travelling time over the rhythm device section depending on the delay or advance noted. The installation can comprise tired wheels staggered all along the transfer rail of the station and the rhythm device section is formed by some of these wheels having a particular drive means and preferably located on the circumference of the rail.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
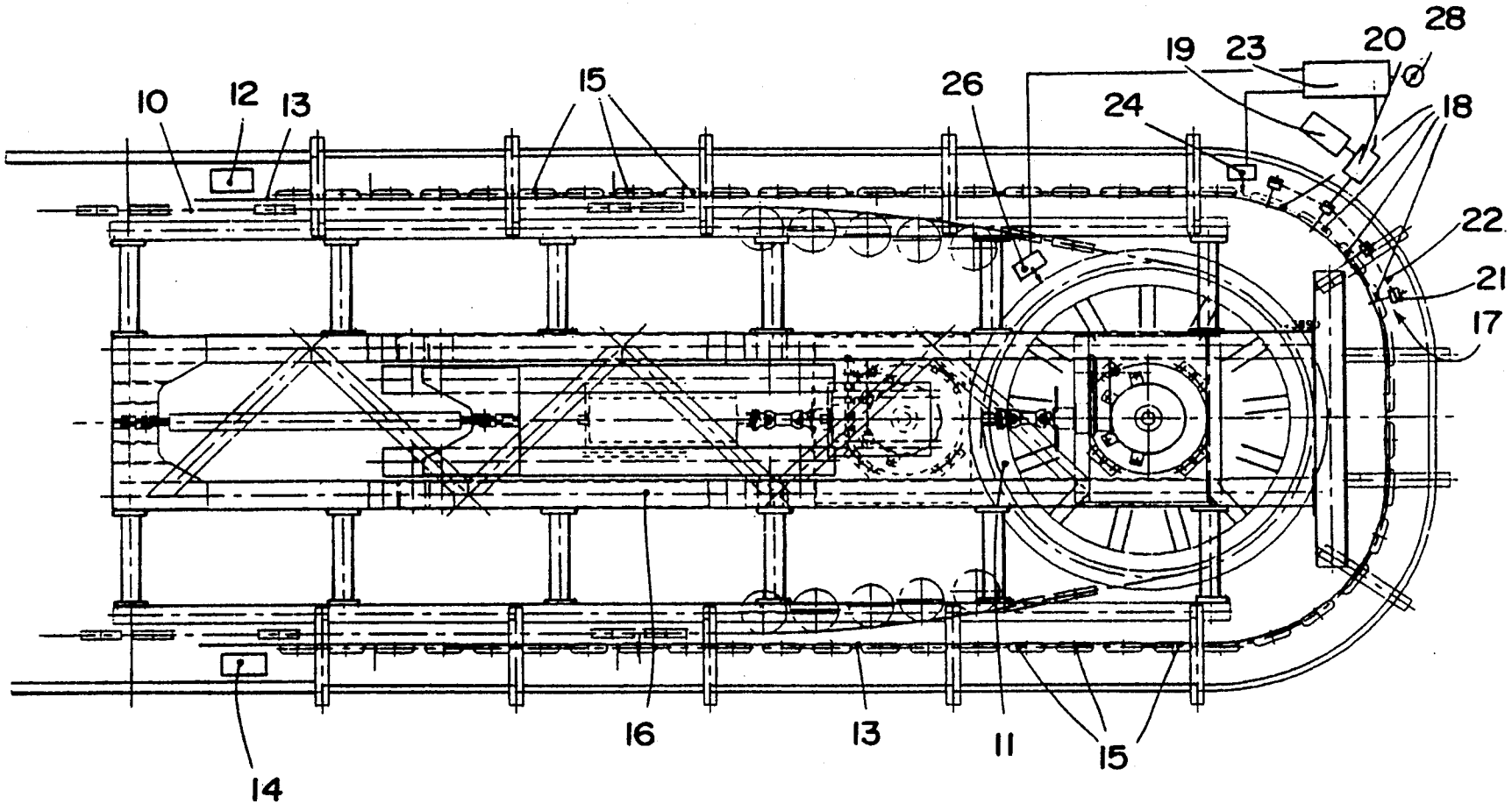
FIG. 1 is a plane view of a station equipped with a rhythm device according to the invention.
Figure 2:
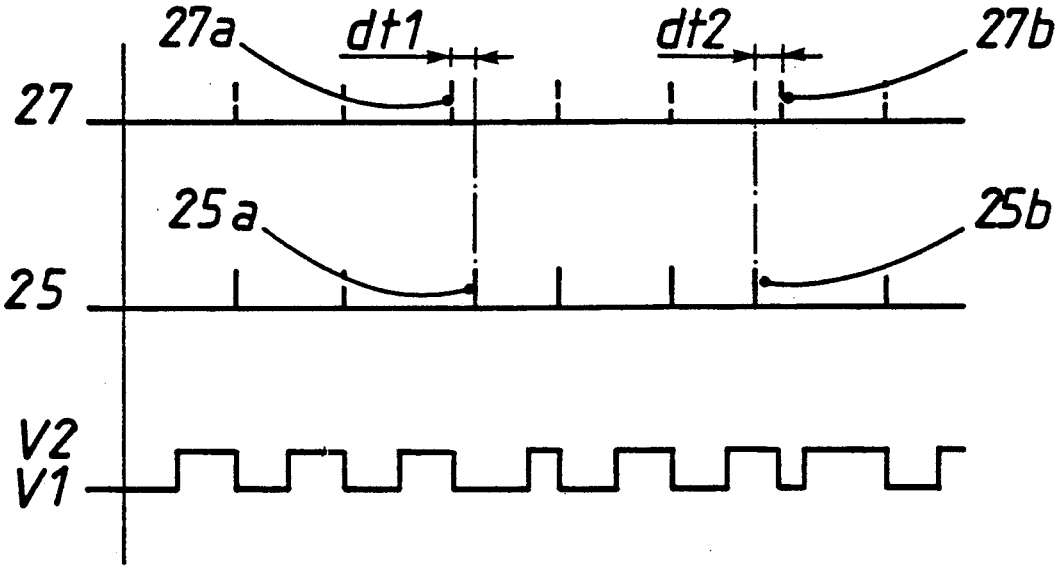
FIG. 2 illustrates the signals received and sent by the controller for individual repositioning of a carriage.
Figure 3:
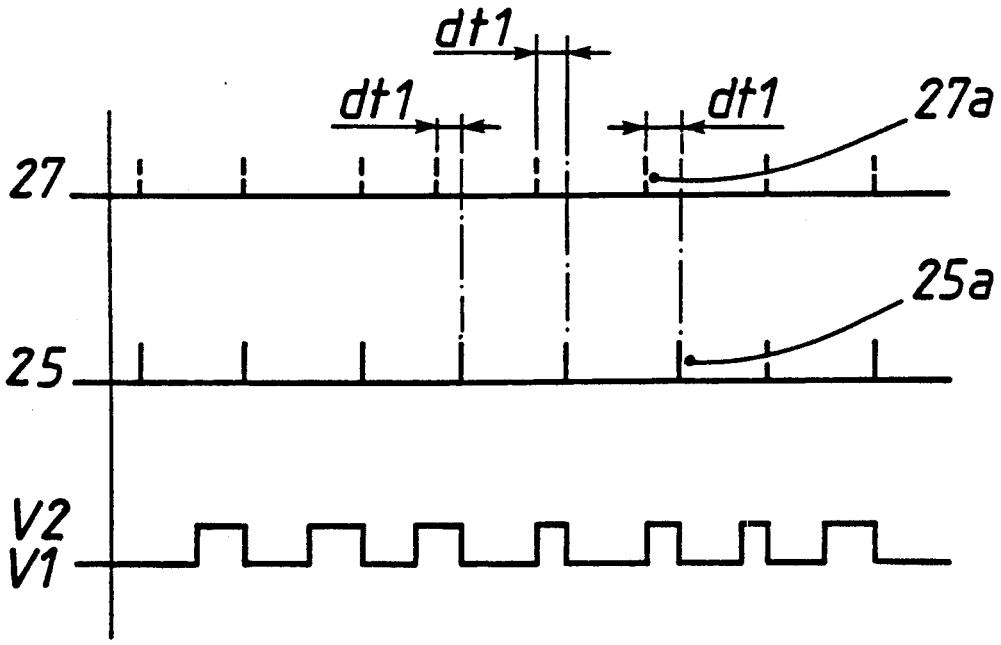
FIG. 3 is an identical view to that of FIG. 2 when a general repositioning takes place.

FIG. 1 corresponds to that of the U.S. patent application No. 07/631,963 filed on Dec. 21, 1990 jointly with the present and entitled "Tension terminal station of a transport installation". The reader can refer to this application for a detailed description of the structure and operation of a detachable chairlift or gondola lift of this kind, which are moreover well-known to those specialized in the art. The invention is described as being applied to a gondola lift, but it is applicable to any other overhead cable installation having detachable carriages, notably a detachable chairlift.

In the Figures, an overhead cable 10 of a gondola lift extends between two terminal stations, running in the stations on end pulleys 11, one of which is a drive pulley driving the cable continuously. The gondola lift represented is of the single-cable type, having carriages (not represented) coupled to the cable on-line. At the entrance 12 to the station the carriages are uncoupled from the cable 10 and run on a transfer rail 13 at reduced speed for loading and unloading of passengers. At the exit 14 from the station, the carriage is recoupled to the cable 10 after being accelerated by a pushing device. Only one of the stations is represented in FIG. 1, the other possibly being identical. Deceleration of the carriage, uncoupled from the cable 10 at the entrance 12 to the station, is performed by a set of wheels with pneumatic tires 15 engaging the gondola support carriage by friction. Wheels 15 of this kind are located along the transfer rail 13 to drive the carriage at slow speed on the rail 13 along the loading and unloading platforms. At the exit 14 from the station, the wheels 15 accelerate the carriage to the speed of the cable 10.

The wheels 15 are driven by systems of pulley and transmission belts by one or more motors, the driving force being also able to be derived from the cable or taken from the return pulley 11. In the example represented, the rail 13 in the form of a half-loop runs round the rear of the return pulley 11 and the pulley 11 and rail 13 assembly is supported by a tension carriage 16 of the cable 10.

A rhythm device section 17, equipped with four tired wheels 18, is located in the zone where the transfer rail 13 runs round. A motor 19 or any other means drives these four wheels 18 in rotation at the same speed, which can be adjusted by means of a pulley 21 and belt 22 assembly and a gear-box 20, for example two-speed, which is controlled by an electronic processor, notably an automatic controller 23, which can perform other functions, in particular control and supervision of the whole installation. The controller 23 receives a signal, supplied by a detector 24 located at the entrance to the rhythm device section and supplying a pulse 25 each time a carriage passes its location. It also receives a periodic clock signal, sent by a detector 26 cooperating with the return pulley 11 and sending pulses 27 synchronized with the running of the cable 10. One of the outputs of the controller 23 is connected to the gear-box 20 and controls the speed change of the wheels 18 of the rhythm device section 17. The other output of the controller 23 is connected to an alarm 28 or preferably to an installation shutdown device.

The rhythm device according to the invention operates in the following manner:

NORMAL OPERATION

The carriage entering the station is uncoupled from the cable 10 and runs on the transfer rail 13 being driven by the tired wheels 15. The first wheels 15 decelerate the carriage, whereas the next ones move it along the platform before reaching the detector 24, located at the entrance to the rhythm device section. If the carriage is correctly positioned, the controller 23 receives the passing pulse 25 and the clock pulse at the same time, the latter corresponding to that sent by the detector 26 or being derived from that sent by the detector 26 to correspond to the selected spacing of the carriages. The controller 23 controls the gear-box 20 so as to drive the four wheels 18 at low speed $V_1$ during the travel under the first two wheels 18 and at high speed $V_2$ during the travel under the last two wheels 18. One of the speeds $V_1$ or $V_2$ is advantageously equal to the driving speed on the other parts of the rail 13. The controller 23 does not detect any deviation and therefore does not send a rephasing or insufficient spacing order. The carriage is driven by the wheels 15 to the station exit where it is reaccelerated and coupled to the cable 10.

INDIVIDUAL SPACING DIFFERENCE (FIG. 2)

When a carriage is accidentally in advance, the passing pulse 25*a*, sent by the detector 24, is ahead of the corresponding clock pulse 27*a* and the controller 23 detects this difference $dt_1$. It orders the speed change later so as to drive the carriage at the slow speed $V_{1a}$ for a longer time than the fast speed $V_{2a}$ and reposition the carriage correctly at the exit from the rhythm device section 17. The controller 23 only detects a deviation which can be corrected by the rhythm device and therefore does not trigger an installation shutdown or periodic signal dephasing. If, however, the difference $dt_1$ was too great to be made up for by driving at the slow speed $V_{1a}$ over the whole rhythm device section 17, the carriage would remain in advance and the controller checks, for example by comparison with the pulse 25 of the previous carriage, whether there is a risk of collision on the curved part of the rail and stops the installation if need be.

In the case of a lagging carriage, the clock signal **27*b* is ahead of the passing pulse 25*b* by a time $dt_2$ and the controller 23 orders the carriage to be moved at the high speed $V_2$ over most of the rhythm device section 17**. The carriage may keep a certain lag which is not made up and the risk of collision with the following carriage then exists. The controller evaluates this risk when the next carriage arrives and stops the installation if need be.

GENERAL SPACING DIFFERENCE (FIG. 3)

A carriage is in advance and the carriage pass pulse **25*a* is staggered by $dt_1$ with respect to the clock pulse 27*a*. The controller 23 controls the rhythm device section 17 in the manner described above to reposition the carriage. The next carriage is also in advance by $dt_1$ and is also repositioned. On the arrival of the third carriage the controller 23 again detects this stagger $dt_1$ and at that moment it triggers an advance dephasing of $dt_1$ of the periodic signal 27 to make the out-of-phase signal, represented by the broken line, coincide with the passing signal and prevent the rhythm device section 17 operating. All the other carriages, also in advance by $dt_1$, are now in phase with the new clock signal and do not require operation of the rhythm device, the adjustment margin of which remains available for individual spacing differences. The spacing of the third carriage with the previous carriage is less, but it remains under the control of the controller 23**, which stops the installation in case of danger. At the next passage all the carriages are again positioned correctly and operation of the rhythm device only involved two carriages.

It is clear that the gear-box 20 can have more than two different speeds with a view to reducing the sudden variations in speed, but the program of the controller 23 is then more complex. A variable speed motor 19 can also be used, controlled by the controller, which can either select a suitable speed, kept constant during travel on the rhythm device section 17, or make the speed vary half-way along in the manner described above.

Driving on the transfer rail 13 and/or on the rhythm device section 17 can be achieved differently, notably by chains with push fingers or by any other means. The spacing between the carriages is adjustable by simply changing the frequency of the clock signal, which can be displayed and/or entered in the controller 23. This clock signal can be established by any other appropriate means.

I claim:

1. An overhead cable transport apparatus comprising:

a continuously movable closed-loop overhead cable extending between a plurality of terminals;

a plurality of load-supporting carriages, each of said plurality of carriages including a detachable grip for coupling each of said plurality of carriages with said continuously movable closed-loop overhead cable;

a transfer rail disposed in each of said plurality of terminals for connecting an inward line and an outward line of said continuously movable closed-loop overhead cable, said transfer rail cooperating with said continuously movable closed-loop overhead cable to form an endless travel path on which said carriages move continuously without stopping;

a rail section of said transfer rail including a rhythm device for varying a travelling time of said plurality of carriages coupled with said rail section to correctly re-position an out-of-phase carriage with respect to a periodic signal synchronized with movement of said continuously movable closed-loop overhead cable, said rhythm device comprising a detection device for identifying an identical deviation of movement of several successive carriages, said detection device comprising a controller to control said rhythm device and vary said travelling time;

said controller having means to receive said periodic signal and a signal representing a passage of said carriages past a preset location, said controller comprising a comparator for determining a deviation between said periodic signal and said signal representing said passage of said carriages past said preset location;

said controller further comprising a memory for recording said deviation and a counter of successive identical deviations, wherein said controller generates a dephasing signal when said counter exceeds a predetermined number, and said dephasing signal adjusts said periodic signal.

2. An apparatus of claim 1, wherein said controller has means to receive periodic clock pulses corresponding to said periodic signal and carriage pass pulses corresponding to said signal representing said passage of said carriages past said preset location, wherein said controller controls said rhythm device to adjust said carriage pass pulses to coincide with said periodic clock pulses and to adjust said periodic clock pulses to coincide with said carriage pass pulses when successive identical deviations occur.

3. An apparatus of claim 1, further comprising means for detecting spacing of said carriages and for controlling at least one of an alarm means and a shutdown means of said apparatus upon detection of a less than predetermined spacing between successive carriages.

4. An apparatus of claim 3, wherein said controller has means to detect a time interval between said passage of successive carriages to activate at least one of said alarm means and said shutdown means upon detection of a less than predetermined time interval.

5. An apparatus of claim 1, wherein said rhythm device further comprises a carriage drive device including a variable speed governor for varying said travelling time.

6. An apparatus of claim 5, wherein said rhythm device further comprises a tired wheel train for driving said carriages by friction and a gear box for driving said tired wheel train at a plurality of speeds, said gear box being controlled by said controller.

7. An apparatus of claim 6, wherein said rhythm device is located on a rail section substantially near a return pulley, and wherein said tired wheel train is staggered along said transfer rail.

* * * * *